US008825408B2

(12) United States Patent
Freed et al.

(10) Patent No.: US 8,825,408 B2
(45) Date of Patent: Sep. 2, 2014

(54) USING MODELS FOR EQUILIBRIUM DISTRIBUTIONS OF ASPHALTENES IN THE PRESCENCE OF GOR GRADIENTS TO DETERMINE SAMPLING PROCEDURES

(75) Inventors: Denise E Freed, Newton Highlands, MA (US); Kentaro Indo, Edmonton (CA); Oliver C Mullins, Ridgefield, CT (US); John Ratulowski, Edmonton (CA); Julian Zuo, Edmonton (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 581 days.

(21) Appl. No.: 12/483,813

(22) Filed: Jun. 12, 2009

(65) Prior Publication Data

US 2009/0312997 A1 Dec. 17, 2009

Related U.S. Application Data

(60) Provisional application No. 61/061,319, filed on Jun. 13, 2008.

(51) Int. Cl.

| | |
|---|---|
| ***G01V 1/28*** | (2006.01) |
| ***G06G 7/57*** | (2006.01) |
| ***G01N 33/26*** | (2006.01) |
| ***E21B 49/08*** | (2006.01) |
| ***E21B 47/00*** | (2012.01) |

(52) U.S. Cl.

USPC ..... 702/11; 703/10; 703/2; 166/336; 166/264; 436/28; 73/19.11; 73/61.43; 73/61.44; 73/152.28

(58) Field of Classification Search

USPC ..... 702/11, 6

See application file for complete search history.

(56) References Cited

U.S. PATENT DOCUMENTS 6,467,340 B1 10/2002 Gallagher et al.
6,647,220 B2 * 11/2003 Wang et al. ..... 399/49

(Continued)

FOREIGN PATENT DOCUMENTS

WO 2009138911 A2 11/2009
WO 2011007268 A1 1/2011

(Continued)

OTHER PUBLICATIONS

N.R. Nagarajan et al., "Reservoir-Fluid Sampling and Characterization-Key to Efficient Reservoir Management", 2007 Society of Petroleum Engineers, JPT, Aug. 2007, pp. 80-91, http://www.spe.org/jpt/print/archives/2007/08/JPT2007_08_DA_series.pdf.*

(Continued)

*Primary Examiner* — Michael Nghiem
*Assistant Examiner* — Alexander Satanovsky
(74) *Attorney, Agent, or Firm* — Daniel S. Matthews

(57) ABSTRACT

Methods and systems to characterize a fluid in a reservoir to determine if the fluid is in one of equilibrium or non-equilibrium in terms of one of gravity, solvency power, entropy effect or some combination thereof. The method includes acquiring tool data at each depth for each fluid sample of at least two fluid samples wherein each fluid sample is at a different depth and communicating the tool data to a processor. Determining formation properties of each fluid sample to obtain formation property data and determining fluid properties for each fluid sample to obtain fluid property data. Selecting a mathematical model based on one of gravity, solvency power or entropy, in view of a fluid property, using one of tool data, formation property data, fluid property data, known fluid reservoir data or some combination thereof, to predict if the fluid is in an equilibrium distribution or a non-equilibrium distribution.

32 Claims, 5 Drawing Sheets

(56) References Cited

U.S. PATENT DOCUMENTS

| | | | | |
|---|---|---|---|---|
| 6,773,921 | B1 * | 8/2004 | Schabron et al. | 436/29 |
| 6,980,940 | B1 * | 12/2005 | Gurpinar et al. | 703/10 |
| 7,081,615 | B2 | 7/2006 | Betancourt et al. | |
| 7,343,270 | B2 | 3/2008 | Mougin et al. | |
| 7,822,554 | B2 | 10/2010 | Zuo et al. | |
| 7,920,970 | B2 | 4/2011 | Zuo et al. | |
| 7,996,154 | B2 | 8/2011 | Zuo et al. | |
| 2007/0120051 | A1 * | 5/2007 | DiFoggio et al. | 250/269.1 |
| 2007/0134804 | A1 * | 6/2007 | Fisher et al. | 436/164 |
| 2007/0234789 | A1 | 10/2007 | Glasbergen et al. | |
| 2008/0040086 | A1 | 2/2008 | Betancourt et al. | |
| 2011/0088895 | A1 * | 4/2011 | Pop et al. | 166/254.2 |

FOREIGN PATENT DOCUMENTS

| | | | |
|---|---|---|---|
| WO | 2011030243 | A1 | 3/2011 |
| WO | 2011121495 | A2 | 10/2011 |

OTHER PUBLICATIONS

J. Ratulowski et al. "Theoretical and Experimental Investigation of Isothermal Compositional Grading", Jun. 2003, SPE Reservoir Evaluation and Engineering, 2003 Society of Petroleum Engineers, pp. 168-175, http://geology.yale.edu/seminars/Westrich.pdf.*

B. Edmonds et al., "A New Method to Give Quantitative Prediction of Asphaltene Deposition From Petroleum Fluids", ISCOP'99, Asphaltenes and Wax Deposition, Nov. 14-17, 1999, Huatulco, Mexico, http://www.infochemuk.com/publicat/papers/ISCOP99.pdf.*

P.L.Oberlander "Fluid Density and Gravitational Variations in Deep Boreholes and Their Effect on Fluid Potential", Ground Water, vol. 27, No. 3, May-Jun. 1989, pp. 341-250, http://info.ngwa.org/gwol/pdf/891549672.PDF.*

Amir Mohsen Mofidi et al., "A simplified thermodynamic modeling procedure for predicting asphaltene precipitation", Fuel 85, 2006, pp. 2615-2621, http://linkinghub.elsevier.com/retrieve/pii/S0016236106001724.*

W.A.England, "Reservoir geochemistry—A reservoir engineering perspective", Journal of Petroleum Science and Engineering, 58 (2007), pp. 344-354.*

D.J.MacMillan et al., "A Unified Approach to Asphaltene Precipitation: Laboratory Measurement and Modeling", Paper (SPE 28990) first presented at the 1995 SPE Intl. Symposium on Oilfield Chemistry, San Antonio, Feb. 14-17, JPT, Sep. 1995, pp. 788-793.*

Betancourt et al, "Predicting downhole fluid analysis logs to investigate reservoir connectivity", IPTC 11488, International Petroleum Technology Conference held in Dubai, UAE, Dec. 4-6, 2007, 11 pages.

Dubost, et al, "Integration of in-situ fluid measurements for pressure gradients calculations", SPE 108494, 2007, 10 pages.

Elshahawi, et al, "Reservoir fluid analysis as a proxy for connectivity in deepwater reservoirs", SPWLA 50th Annual Logging Symposium held in the The Woodlands, TX Jun. 21-24, 2009, 14 pages.

Flory, "Thermodynamics of high polymer solutions", Journal of Chemical Physics, vol. 10, Jan. 1942, pp. 51-61.

Freed et al, "Theoretical treatment of asphaltene gradients in the presence of GOR gradients", Energy Fuels 2010, 24 pp. 3942-3949.

Fujisawa, et al, "Large hydrocarbon compositional gradient revealed by in-situ optical spectroscopy", SPE 89704, SPE ATCE Houston, Sep. 2004, 6 pages.

Gisolf et al, "Real time integration of reservoir modeling and formation testing", SPE 121275, 2009 SPE EUROPEC/EAGE Annual Conference and Exhibition held in Amsterdam, The Netherlands, Jun. 8-11, 2009.

Hoier et al, "Compositional Grading-Theory and Practice", NTNU/Pera, SPE 63085, 2000 SPE Annual Technical Conf and Exhib Dallas, Texas Oct. 1-4, 2000, 16 pages.

Indo et al, "Asphaltene nanoaggregates measured in a live crude oil by centrifugation" Energy Fuels 2009, 23, pp. 4460-4469.

Lira-Galeana et al, "Computation of compositional grading in hydrocarbon reservoirs. Application of continuous thermodynamics" Fluid Phase Equilibria 102 (1994), pp. 143-158.

Montel et al, "Prediction of Compositional Grading in a Reservoir Fluid Column", SPE 14410, 60th Annual Technical Conference and Exhibition of the Society of Petroleum Engineers held in Las Vegas NV, Sep. 22-25, 1985, 12 pages.

Mullins et al, "Asphaltenes gravitational gradient in a deepwater reservoir as determined by downhole fluid analysis" SPE 106375, Mar. 2007, 6 pages.

Mullins et al, "The colloidal structure of crude oil and the structure of oil reservoirs", Energy & Fuels, 2007, 21, pp. 2785-2794.

Wang et al, "A two-component solubility model of the onset of asphaltene flocculation in crude oils", Energy and Fuels 2001, pp. 1004-1012.

Whitson, "Compositional gradients in petroleum reservoirs", SPE 28000, University of Tulsa Centennial Petroleum Engineering Symposium held in Tulsa, OK Aug. 29-31, 1994, 17 pages.

Wiehe, Petroleum fouling: causes, tools, and mitigation methods Soluble Solutions, Gladstone, NJ, 15 pages, 2006.

Zuo et al, "Integration of fluid log predictions and downhole fluid analysis", SPE 122562, 2009 SPE Asia Pacific Oil and Gas Conference and Exhibition held in Jakarta, ID Aug. 4-6, 2009, 11 pages.

Zuo et al, "Investigation of formation connectivity using asphaltene gradient log predictions coupled with downhole fluid analysis", SPE 124264, 2009 Annual Technical Conference and Exhibition held in New Orleans, LA Oct. 4-7, 2009, 11 pages.

Zuo et al, "Methodology for Determination of reservoir complexity from DFA tools and EOS predictions", IPTC 13163, Doha, Qata, Dec. 7-9, 2009, 7 pages.

International Search Report and Written Opinion of PCT Application No. PCT/US2009/047355 dated Jan. 25, 2010.

Hirschberg, "Role of Asphaltenes in Compositional Grading of a Reservoir's Fluid Column," Journal of Petroleum Technology, Jan. 1988: pp. 89-94.

* cited by examiner

USING MODELS FOR EQUILIBRIUM DISTRIBUTIONS OF ASPHALTENES IN THE PRESCENCE OF GOR GRADIENTS TO DETERMINE SAMPLING PROCEDURES

BACKGROUND OF THE INVENTION

1. Field of the Invention

The present invention is directed to a method correlating measured composition data of oil gathered downhole by a logging tool with predicted composition data of the oil, so as to determine whether Asphaltenes are in an equilibrium distribution within the reservoir in terms of a thermodynamic description and without any exterior influences, e.g., without disturbances from dynamic reservoir processes. More particularly, the invention relates to providing a method for determining the equilibrium distribution of Asphaltenes in oil in a column of a reservoir in terms of gravity and solvency power using downhole logging tools, where the oil is characterized as containing dissolved gases in solution which can be released from the solution (oil) at surface conditions, e.g., live oil.

2. Background of the Invention

Over the years, it was believed that there was fluid homogeneity in a hydrocarbon reservoir. However, there is a growing awareness that fluids are often heterogeneous in the reservoir. Reservoir fluids often demonstrate complicated fluid compositions, properties, and phase behaviors in single columns due to the impacts of gravity, thermal gradients, biodegradation, active charging, water washing, leaky seals, and so on. In addition, reservoir compartmentalization leads to discontinuous compositional distributions. Identifying these discontinuities can provide for a significant cost savings in the overall oil exploration and drilling costs if determined early in the process of extracting oil from the reservoir. Therefore, gathering information on these fluid properties downhole can be a difficult process which may require a greater number of fluid samples and related laboratory analysis. Presently, there is not a theoretical formulism or method in the industry that tests or verifies the sensibility of the collected measured data in the reservoir before commencing drilling operations. In particular, there is not a method that compares gas-oil ratio (GOR) and/or composition and color data and/or asphaltene data of the crude oil with models based on first principles of the asphaltene properties to see if the data makes sense or is even accurate.

Some known methods for collecting measured data in a reservoir include Downhole fluid analysis (DFA) measurements that provide for a useful tool to determine the compositional gradients at downhole conditions in real time. However, as pointed out by Mullins et al. (XXX), for large sand bodies in the Gulf of Mexico, for example, fluid compositional gradients may not be obvious from the properties, e.g., $CO_2$, $C_1$, $C_2$, $C_3$-$C_5$ and $C_6^+$, and gas-oil ratio (GOR) measured by DFA tools (see Oliver C. Mullins, Soraya S. Betancourt, Myrt E. Cribbs, Jefferson L. Creek, Francois X. Dubost, A. Ballard Andrews, Lalitha Venkataramanan, Asphaltene Gravitational Gradient in a Deepwater Reservoir as Determined by Downhole Fluid Analysis, , SPE 106375, Houston, 2007). According to the composition and GOR data obtained by the DFA tools, the flow connectivity in the reservoir may not be identified. However, the detailed downhole and laboratory analyses of asphaltene contents (the densest component of crude oils) show apparent asphaltene gradients with depth (although resin gradients are not evident). This information provides for a method that can determine flow connectivity in the reservoir by measuring asphaltene contents with depth at downhole conditions, especially when other fluid property and compositional gradients are not observable. However, this method does not determine the distribution of asphaltenes in live oil in a column of a reservoir in terms the thermodynamic drive of solvency power, where the live oil is defined as containing dissolved gases in solution which can be released from the solution (oil) at surface conditions. Moreover, this method is not a first principles model based on equilibrium distribution and is not based on a known liquid phase composition so as to predict a dissolved asphaltene content in the live oil. Also, current DFA tools cannot directly measure asphaltene content other than the coloration of reservoir fluids which is associated with the asphaltene content.

Referring to aspects of compositional gradients, Equations of state (EoS) models have been used to model the compositional gradients due to the gravitational effects in reservoirs. The standard EoS that can be used in the oil business derives from a modified ideal gas law. For example the popular Peng-Robinson equation of state which is ubiquitous in modeling oil is a modified Van Ver Waals equation of state. In these equations the deviation from the ideal gas law is largely accounted for by 1) introducing a finite (not zero) molecular volume and 2) introducing some intermolecular attraction. These parameters are then related to the critical constants of the different chemical components. Standard EoSs are used throughout to model gas-oil ratio and compositional gradients in oil reservoirs of light ends, alkanes and small aromatics. However, this formalism is not designed to model heavy ends such as asphaltenes. More generally, the treatment of heavy ends is more associated with a constitutive equation which can be used to fit the distribution of asphaltenes based on parameters which may not be explicable from first principles. Nevertheless, to date the industry has handled treatment of asphaltenes in this manner primarily because there had been no agreement about the chemical nature of asphaltenes. If this chemistry is unknown, then a first principles approach is precluded.

Recently, several fundamental chemical properties of asphaltenes have been established. Their molecular weight is now known. (A decade ago, there were orders of magnitude debate about this). In addition, the asphaltene molecular architecture is now largely understood. Finally, the existence of asphaltene nanoaggregates of very small size has now been established in model solvents and in crude oils. Moreover, asphaltenes are much simpler than previously thought making treatment of asphaltenes from first principles much more tractable.

However, there are no known industries or known prior art addressing compositional gradients of asphaltenes (and asphaltene nanoaggregates) within the framework of polymer solution theory (Flory-Huggins theory). Further, there are no known industries or known prior art that are attempting to use the above noted approach in a way designed to handle heavy ends. Moreover, the above mentioned approach is not used with Equation of State (EoS) modeling because EoS modeling is designed to handle light ends while asphaltenes are the heaviest end of crude oil.

Laboratories generally do not treat compositional gradients because typical laboratory fluid columns are less than one foot high so no gradients exist. In the reservoir, it is not uncommon to have a 3,000 feet oil column in a tilted reservoir, thus with such a large column, gradients show up. In addition, because reservoir oils are under high pressure, there can be substantial dissolved gas, unlike a column in a laboratory. It should be noted that dissolved gas increases fluid compressibility giving rise to large density gradients which in turn give rise to large compositional gradients. The reason these gradients in dissolved gas are treated with standard EoS methods is because these methods handle light end distributions. However, since it is very difficult to create large fluid column heights under high pressure in the lab, there was little need (either by industries or inventors) to model compositional gradients of light ends, let alone heavy ends.

U.S. Pat. No. 7,081,615 B2, describes a DFA tool used in acquiring a fluid sample from the formation and incorporated herein by reference. The tool is able to determine compositional data of four or five components and some basic fluid properties, such as live fluid density, viscosity, and coloration. In related U.S. Provisional Patent Application 61/023,135 entitled "Methods of Downhole Fluid Characterization Using Equations of State" (hereafter "'135") and incorporated herein by reference, the methods of interpreting DFA data are described, which include how to delump $C_3$-$C_5$ (or $C_2$-$C_5$), to characterize $C_{6+}$ components, to obtain a representative EOS model, and to predict PVT properties. However, U.S. Provisional Patent Application '135 addresses highly non-equilibrium columns where the asphaltene content is controlled by very different mechanisms. In fact, the '135 Provisional Patent Application uses EOS (equation of state) which is based on first principles for the light ends and is not designed to be a first principle approach for the distribution of heavy ends. Also, '135 Provisional Patent Application does not use a polymer solution theory, which is designed to be a first principles approach for components like the asphaltenes and colored components. Moreover, the '135 Provisional Patent Application does not address an equilibrium distribution nor predict the distribution of the asphaltenes in live crude oil in view of known liquid phase compositions at any given depth or location, in terms of the thermodynamic drive of solvency power. Further still, the '135 Provisional Patent Application requires data base of color versus asphaltene content as well as requiring determining the actual asphaltene content. It would be beneficial to develop a new method that does not require having a database of color versus asphaltene content nor having to determine the actual asphaltene content.

Due to the impacts of gravity, chemical forces, molecular and thermal diffusion, natural convection, biodegradation, adsorption, and external fluxes, non-equilibrium hydrocarbon distribution frequently can exists in the reservoir. Determination of compositional and property gradients, and reservoir connectivity, can be of importance to the oil and gas industry. DFA tools are useful and powerful for determining compositional and property gradients with depth at downhole conditions in real time. Where compositional and property gradients with depth in the reservoir are unobservable by means of DFA tools, a method of associating the coloration measured by DFA tools with asphaltene content, and then determining the distribution of asphaltenes and color components solvated in the liquid phase of live oil, in terms of the thermodynamic drive of gravity and solvency may be required.

In the Buckley reference, the Flory-Huggins model is applied to homogeneous mixtures of oils with asphaltenes, in order to predict the onset of flocculation. It does not address the equilibrium behavior of asphaltenes subject to gravity effects in oils with compositional gradients (see Jill Buckley is J. X. Wang and J. S. Buckley, "A Two-Component Solubility Model of the Onset of Asphaltene Flocculation in Crude Oils", Energy and Fuels 2001, 15, 1004-1012.).

Mullins, and Betancourt consider gradients in asphaltenes due to gravity effects in oil columns (see Oliver C. Mullins, Soraya S. Betancourt, Myrt E. Cribbs, Francois X. Dubost, Jefferson L. Creek, A. Ballard Andrews, and Lalitha Venkataramanan, "The Colloidal Structure of Crude Oil and the Structure of Oil Reservoirs", Energy & Fuels 2007, 21, 2785-2794) (see Soraya S. Betancourt, Francois X. Dubost, Oliver C. Mullins, Myrt E. Cribbs, Jefferson L. Creek, Syrizc G. Mathews, "Predicting Downhole Fluid Analysis Logs to Investigate Reservoir Connectivity", International Petroleum Technology Conference, IPTC 11488, Dubai, UAE, Dec. 4-6, 2007.). The columns in these papers do not have large amounts of dissolved gas, so the solubility (and entropy) effects are not addressed.

Fujisawa at el. and Dubost et al. consider an oil column where there is a gradient in both the light ends and the color (see F. Dubost, A. Carnegie, O. C. Mullins, M. O. Keefe, S. Betancourt, J. Y. Zuo, and K. O. Eriksen, "Integration of In-Situ Fluid Measurements for Pressure Gradients Calculations", SPE 108494, 2007). The one by Fujisawa et al. does not give a model for any of the compositional gradients, including asphaltene gradients (see G. Fujisawa, S. S. Betancourt, O. C. Mullins, T. Torgersen, T. Terabayashi, C. Dong, K. O. Eriksen, "Large Hydrocarbon Compositional Gradient Revealed by In-Situ Optical Spectroscopy", SPE 89704, SPE ATCE Houston, September 2004.). It only says that if there is a variation in the composition, additional samples should be taken.

The paper by Dubost et al. (noted above) uses an EoS model for the fluid to find a method for properly fitting the pressure data and does not address the asphaltene or color gradient.

Standard references on compositional grading in oil columns, such as Whitson et al., (see Lars Høier, SPE, Statoil and Curtis H. Whitson, "Compositional Grading—Theory and Practice", NTNU/Pera, SPE 63085, 2000 SPE Annual Technical Conference and Exhibition Dallas, Tex., 1-4 Oct. 2000), Model at al. (see F. Montel and P. L. Gouel, Elf, "Prediction of Compositional Grading in a Reservoir Fluid Column", SPE 14410, presentation at the Wth Annual Technical Conference and Exhibition of the Society of Petroleum Engineers held in Las Vagaa, Nev. Sep. 22-25, 1995.) and Firoozabadi et al. (see Carlos Lira-Galeana, Abbas Firoozabadi, and John M. Prausnitz, "Computation of Compositional Grading in Hydrocarbon Reservoirs, Application of Continuous Thermodynamics", Fluid Phase Equilibria, 102 (1994), 143-158.) use equation of state methods.

SUMMARY OF THE INVENTION

The present invention relates to a method correlating measured composition data of live oil gathered using a downhole logging tool with predicted composition data of the oil, so as to determine whether asphaltenes are in an equilibrium distribution within the reservoir in terms of a thermodynamic description and without any exterior influences, e.g., without disturbances of geo-market processes. More particularly, the invention relates to providing a method for determining the distribution of asphaltenes and color components in live oil in a column of the reservoir that is solvated in the liquid phase, in terms of gravity and solvency power at any given depth or location by using downhole logging tools. Whereby measured coloration data is correlated with predicted asphaltene content data, so as to determine whether Asphaltene was distributed by a natural progression within the reservoir in terms of a thermodynamic description without disturbances of geo-market processes.

Further features and advantages of the invention will become more readily apparent from the following detailed description when taken in conjunction with the accompanying Drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PREFERRED EMBODIMENTS

Figure 1A:
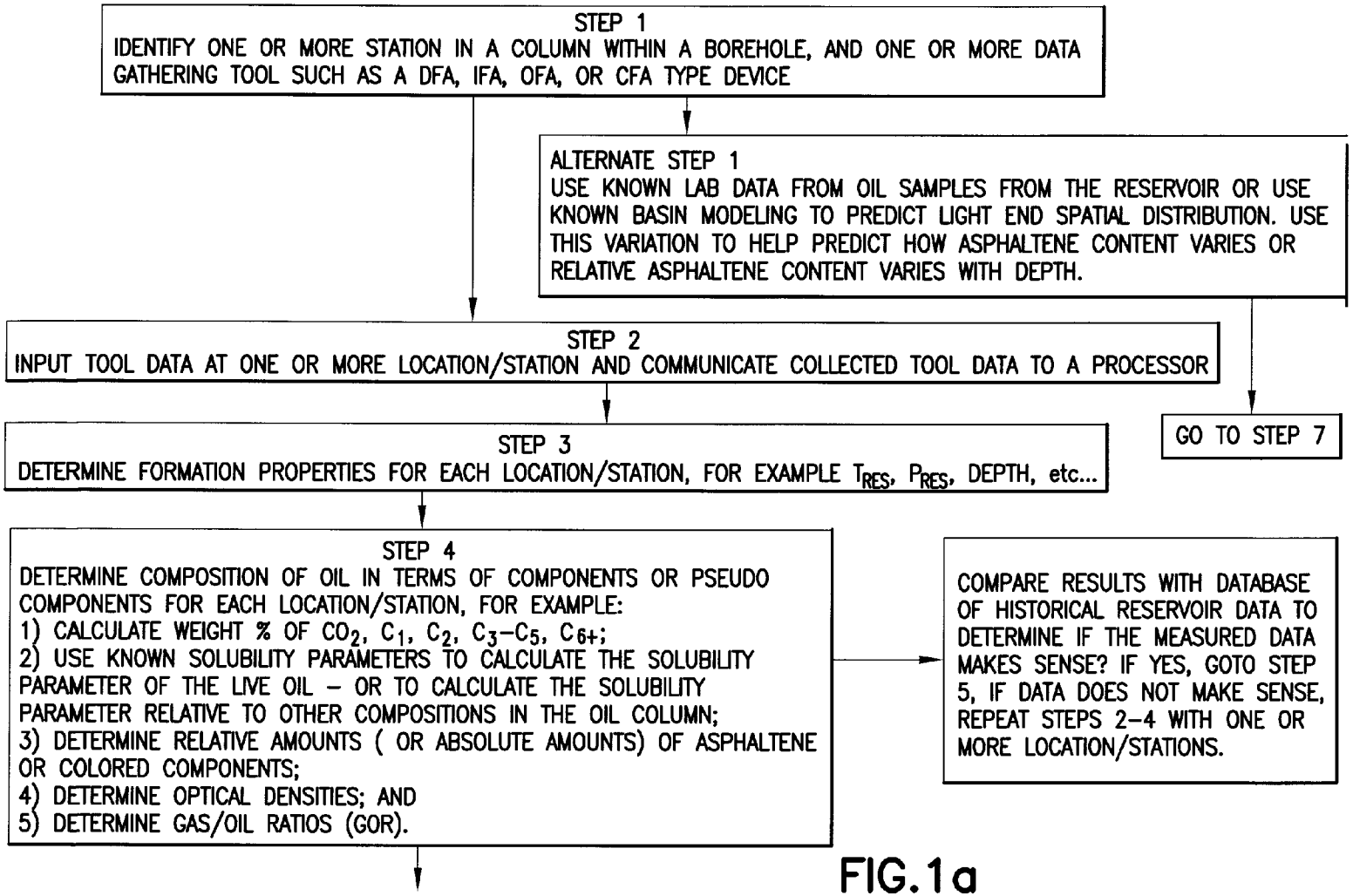
FIGS. 1*a* and 1*b* illustrate a general workflow diagram, according to at least one embodiment of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

The present invention is directed to a method correlating measured composition data of live oil gathered using a downhole logging tool with predicted composition data of the oil, so as to determine whether asphaltenes are in an equilibrium distribution within the reservoir in terms of a thermodynamic description and without any exterior influences, e.g., without disturbances of geo-market processes. More particularly, the invention relates to providing a method for determining the distribution of asphaltenes and color components in live oil in a column of the reservoir that is solvated in the liquid phase, in terms of gravity and solvency power at any given depth or location by using downhole logging tools. Whereby measured coloration data is correlated with predicted asphaltene content data, so as to determine whether Asphaltene was distributed by a natural progression within the reservoir in terms of a thermodynamic description without disturbances of geo-market processes.

Accordingly, at least one embodiment of a method of the invention provides for characterizing the distribution of live oil in a reservoir, in part, characterizing the Asphaltenes solvated by the liquid fraction and how to relate the solvating power of the liquid fractions for the Asphaltene and/ or color components so as to determine whether the reservoir crude oils are in thermodynamic equilibrium in the reservoir.

Reservoir crude oils are sometimes present in thermodynamic equilibrium in the reservoir. However, in many cases, these fluids are not in equilibrium due to a variety of factors. For example, both current reservoir charging and biodegradation can cause the fluids to exhibit large nonequilibrium compositional gradients. Moreover, it is plausible that some chemical components exhibit equilibrium while others do not in a crude oil. Asphaltenes have small diffusion constants and can be the last components to attain equilibrium. According to aspects of the invention, it is possible to measure the relative concentration of asphaltenes or at least the relative concentration of colored species in a crude oil. For example, by colored, it can be understood to be those chemical constituents with electronic absorption bands in the near UV, visible and or near infrared spectral range.

According to an aspect of the method of the invention, it is possible an equilibrium theory can adequately address the bulk of the variation of asphaltenes or colored species in a reservoir crude oil. In such a case, fewer samples and DFA stations are needed as interpolation of fluid properties is easily performed. However, if 1) the fluid column is not in equilibrium, 2) if the fluid column is compartmentalized or 3) if the column is amenable only to a complex theoretical formalism, then it becomes necessary to acquire more DFA and sample stations. To address the above question, it is necessary to develop a simple theoretical formalism or method for crude oils that can treat black oils, where aside from asphaltene concentration there is little variation in the liquid phase, as well as crude oils that exhibit large variations in the liquid phase.

Thus, according to an aspect of the method of the invention, it is possible to develop an equilibrium theory for treating the variation of asphaltenes or colored species (or components) in crude oil vs. position in the reservoir. Further, an aspect of the method of the invention can describe a protocol for how a method can be used in assessing whether more DFA and sampling stations would be needed during a wireline or LWD job.

It is noted that at least one embodiment of a method of the invention includes an approach that treats asphaltenes (and asphaltene nanoaggregates) within the framework of polymer solution theory (Flory-Huggins theory). This approach is designed to handle heavy ends. This theory or method has been successfully used to treat asphaltene phase behavior in the laboratory; in particular, asphaltene flocculation has been treated with polymer solution theory. In this application, Equation of State modeling is not used because EoS modeling is designed to handle light ends while asphaltenes are the heaviest end of crude oil. Our approach is to use asphaltene solution theory to handle asphaltene gradients in the formation.

As noted above, laboratories generally do not treat compositional gradients because laboratory fluid columns are typically less than one foot high so no gradients exist. In the reservoir, it is not uncommon to have a 3,000 feet oil column in a tilted reservoir, such that in a large column, gradients show up. In addition, because reservoir oils are under high pressure, there can be substantial dissolved gas. This dissolved gas increases fluid compressibility giving rise to large density gradients which in turn give rise to large compositional gradients. Since it is very difficult to create large fluid column heights under high pressure in the lab, there has been little need (within the industry or known prior art) to model compositional gradients of light ends, let alone heavy ends.

According to an embodiment of a method of the invention, the method is novel in that it applies polymer solution theory, typically used for phase transitions (flocculation) of asphaltenes in homogeneous laboratory solutions, to treat heavy end compositional gradients, where the industry (prior art) focus has been on light end modeling. One aspect of the Flory-Huggins model is that the solubility parameter and entropy play an important role in determining the solvency of the asphaltenes and their equilibrium distribution in an oil column. An important aspect of the invention is that it uses the least possible number of parameters to fit the data, and the parameters are based on fundamental properties of the asphaltenes, such as their size. With a small number of parameters, the downhole data can be quickly fit to the model, which can make it possible to check in real time whether the downhole data reflects an equilibrium distribution for the asphaltene.

In crude oil, the number density of Asphaltene can have a gradient as a function of height due to the gravitational buoyancy effect (see Fujisawa at el. and Dubost et al.). The color of the oil is related to an amount of Asphaltene. Thus, by measuring the color of the oil, one can determine whether the oil is in equilibrium. If the color of the oil lies along the curve (or family of curves) predicted for an equilibrium distribution, and as long as other measurements such as GOR, pressure, etc., also indicate equilibrium, then not that many MDT measurements may be needed in that specific zone. If the asphaltene measurement does not follow the behavior predicted by the equilibrium model, then many more measurements may be needed, either because of compartments, non-equilibrium conditions, or fluids which require greater complexity in order to be modeled.

Accordingly, an embodiment of a method of the invention provides for characterizing the distribution of live oil in a reservoir, in part, characterizing the Asphaltenes solvated by the liquid fraction and how to relate the solvating power of the liquid fractions for the Asphaltene and/ or color components so as to determine whether the reservoir crude oils are in thermodynamic equilibrium in the reservoir. In this case, the methane content (and other light ends) can vary as a function of height due to the compressibility of the fluid (or live oil) and the hydrostatic head pressure according to Le Chatlier's principle. The changing methane content will change the solubility of the heavy ends, where the heavy ends are the asphaltenes or color components of the oil. These heavy ends become less soluble as the methane content increases. In this case, in order to predict the asphaltene concentration as a function of height, one needs to take into account not only the gravitational effects, but also the solvency effect. The detailed equations for this will be given below.

In particular, according to an aspect of the method of the invention, the method provides for using the components from IFA or (similar tool) such as $C_1$, $C_2$, $C_3$-$C_5$, $C_6^+$ and $CO_2$ to predict the solubility of the asphaltenes. Other possible choices for components or pseudocomponents could be used, such as the dissolved gases, the saturates, the aromatics and the resins. From this, it is possible to predict the equilibrium distribution of the asphaltene in the continuous phase. By also monitoring the color as a function of the height, we can determine whether or not the asphaltenes are in equilibrium. If they are not, this indicates that additional MDT samples may be required.

In addition, oils such as condensates have little or no asphaltenes, but they still can have colored components or components with electronic transitions in the visible and UV or near UV spectral range. We can also use the non-colored components or pseudocomponents to determine the equilibrium distribution of these colored components. This can again be used to determine whether additional MDT samples might be required.

According to an embodiment of a method of the invention, this can be an example of a model that can be used to determine the equilibrium distribution of the asphaltene when the composition of the rest of the oil is known. It is assumes that the concentration of asphaltene is small enough that it does not have a significant effect on the composition of the rest of the oil. To determine the solubility of the asphaltene, the oil can be described by a two component Flory-Huggins type model, similar to the one used in Ref. (see Buckley referenced in the Background section). The asphaltenes are the first component, and the rest of the oil, or the maltene, is lumped together for the second component. At each height h, there are $n_m(h)$ maltene molecules and $n_a$ asphaltene molecules. These numbers are allowed to vary in order to find the minimum of the free energy. The average volume of a maltene molecule is $v_m(h)$. This can vary somewhat as a function of h as the composition of the maltene changes. The asphaltenes can be in aggregates, clusters or single molecules. We will take $v_a$ to be the average size of the asphaltene particles in the fluid, and we will assume that it is constant as a function of height. The total volume of fluid at each height is $$V_T(h)=v_m n_m+v_a n_a.$$

Unlike in the calculations of the onset of asphaltene instability, we will be assuming that the fluid remains a single phase at all heights. Thus, there is only one volume of the single phase and we will take $V_T(h)$ to be constant as a function of moles of asphaltenes and solvent.

The volume fractions of the maltene and asphaltene at each height are given by $\phi_m(h)=n_m/V_T$ and $\phi_a(h)=n_a/V_T$, respectively, and they sum to 1:

$$\phi_m(h)+\phi_a(h)=1. \quad \text{Eq. (1)}$$

The solubility parameter of the asphaltene is $\delta_a$, and the solubility parameter of the maltenes, $\delta_m(h)$ depends on the composition of the maltene at each height.

The free energy at height (h) for the asphaltene and solvent oil is given by $$\Delta G(h)=\Delta G_{entropy}(h)+\Delta G_{sol}(h)+\Delta G_{gravity}(h), \quad \text{Eq. (2)}$$

where $\Delta G_{entropy}$ (h) is the free energy due to the entropy of mixing, $\Delta G_{sol}$ (h) is the free energy due to the solubility of the asphaltene in the maltene, and $\Delta G_{grav}$ (h) is the free energy due to gravity. When the difference in sizes between the solute and solvent are not taken into account, the entropy of mixing is given by $$\Delta G_{entropy}(h)=kT(n_m(h)\ln n_m(h)+n_a(h)\ln n_a(h)). \quad \text{Eq. (3)}$$

Once there is a difference in size between the solute and solvent, several different values for the entropy of mixing have been used, including the one given above for molecules of equal size. Alternatively, in reference P. J. Flory (see Paul J. Flory, "Thermodynamics of Hig Polymer Solutions", Journal of Chembical Physics Vol. 10, January (1942)), in the limit of large monomers with volume $v_a$ dissolved in a solvent made of smaller molecules with volume $v_m$, Flory found that the entropy of mixing is given by $$\Delta G_{entropy}=kT((v_m/v_a)n_m \ln \phi_m+n_a \ln \phi_a). \quad \text{Eq. (4)}$$

Often, instead, the ratio $v_m/v_a$ is omitted from the above equation. However, that version was derived for flexible polymers, and the asphaltene is more like a single segment, so we will use the expression given in Eq. (4). It is also possible to use Eq. 4 with the ratio $v_m/v_a$ set to 1. In that case, the exponent in Eq. (10) and Eq. (12) will contain an additional term due to entropy effects.

The part of the free energy due to the solubility of the asphaltenes is given by $$\Delta G_{sol}=n_m(h)\phi_a(h)v_m(\delta_a-\delta_m(h))^2. \quad \text{Eq. (5)}$$

The free energy due to gravity is given by $$\Delta G_{gravity}(h)=g(n_m(h)v_m(h)\rho_m(h)h+n_a(h)v_a\rho_a h), \quad \text{Eq. (6)}$$

where $\rho_a$ and $\rho_m$ are the densities of the asphaltene and maltene, respectively. Because the sum of the asphaltene and maltene volume fractions at each height is equal to one, we can eliminate $\phi_m$ and $n_m$ from the expression for the free energy to obtain $$\Delta G(h) = kT\left(n_a \ln\phi_a + \left(\frac{V_T}{v_a} - n_a\right)\ln(1-\phi_a)\right) + n_a v_a (1-\phi_a)(\delta_a - \delta_m)^2 + g n_a v_a h(\rho_a - \rho_m) + g V_T \rho_m h. \quad \text{Eq. (7)}$$

The chemical potential of the asphaltene at height h is then the derivative of ΔG(h) with respect to $n_a$:

$$\mu_a(h) = kT(\ln \phi_a - \ln(1-\phi_a)) + (1-2\phi_a) v_a (\delta_a \delta_m)^2 + g\, v_a h (\rho_a - \rho_m). \quad \text{Eq. (8)}$$

The condition for equilibrium is that the chemical potentials for the asphaltene are the same at all heights, so that $$\mu_a(h_1) = \mu_a(h_2). \quad \text{Eq. (9)}$$

This gives the condition that $$\frac{\phi_a(h_1)}{\phi_a(h_2)} \frac{\phi_m(h_2)}{\phi_m(h_1)} = \exp(-v_a g[h_1 \Delta\rho(h_1) - h_2 \Delta\rho(h_2)]/kT - S(h_1, h_2)/kT, \quad \text{Eq. (10)}$$

where $$S(h_1, h_2) = v_a[(1-2\phi_a(h_1))(\delta_a - \delta_m(h_1))^2 - (1-2\phi_a(h_2))(\delta_a - \delta_m(h_2))^2], \quad \text{Eq. (11)}$$

and $\Delta\rho(h) = \rho_a(h) - \rho_m(h)$. If the asphaltene volume fraction is much less than one, then this becomes $$\frac{\phi_a(h_1)}{\phi_a(h_2)} = \exp(-v_a g[h_1 \Delta\rho(h_1) - h_2 \Delta\rho(h_2)]/kT) \times \exp(-v_a[(\delta_a - \delta_m(h_1))^2 - (\delta_a - \delta_m(h_2))^2]/kT). \quad \text{Eq. (12)}$$

If the composition of the solvent oil does not change as a function of height, then this reduces to the familiar expression $$\frac{n_a(h_1)}{n_a(h_2)} = e_a^{-v(h1-h2)\Delta\rho/kT}, \quad \text{Eq. (13)}$$

which was used in Ref. (see Fujisawa at el. and Dubost et al.) to describe the variation in asphaltene density when the composition of the maltene did not vary.

Finding the Solubilities of the Maltene and Asphaltene

The equation for asphaltene equilibrium depends on the solubility parameter $\delta_m$ of the maltene. Often, the full composition and properties of the maltene are not known. Instead, the mass or mole fractions of a set of components or pseudocomponents may be given. For example, the amounts of the five components and one pseudocomponent, $C_1$, $C_2$, $C_3$-$C_5$, $C_6^+$ and $CO_2$, is determined by the IFA. Other choices for components and pseudocomponents can be used, such as the dissolved gases, the saturates, the aromatics and the resins. In addition, the amount of color can be measured. This colored component may consist only of asphaltenes or it can be a pseudocomponent with no asphaltenes, or it can be a combination of both.

The solubility parameter for a mixture $\delta_m$ is an average of the solubility parameters $\delta_i$ for each component, given by:

$$\delta_m = \left(\sum_i \phi_i \delta_i\right) \Big/ \sum_i \phi_i\Big) \quad \text{Eq. (14)}$$

Here, $\delta_i$ may be the known solubility parameter of the actual components of the oil, or an estimate or fit to data (such as centrifugation data) for components or pseudocomponents of the oil. Strictly speaking, $\phi_i$ is supposed to be the volume fraction of each component or pseudocomponent, which may be estimated from the mass or mole fractions, or from an equation of state. In order to obtain an estimate for the solubility parameter of the maltene, the mass fraction or mole fraction could be used instead of the volume fraction.

The equations for the asphaltene equilibrium also depend on the density of the maltene. This can be found from the optical data or other measurements or from an equation of state. For example, if the partial densities, $\rho_i$ are known, then the density of the maltene is given by $\rho_m = \Sigma \rho_i \phi_i$.

Once the solubility parameter and density of the maltene are known, then the equation for the asphaltene equilibrium, Eq. (10) or Eq. (12) can be viewed as a function of two parameters, the volume and solubility of the asphaltene, if we assume the asphaltene has a density of about 1.1 or 1.2 g/cc. Then Eq. (10) or Eq. (12) determines a family of curves for the asphaltene content or the color as a function of height. This can be fit to the data to determine the possible values of $v_a$ and δ. If no fit is possible, then the asphaltene might not be in equilibrium or a more complex formalism is needed to describe the oil. Similarly, if the oil is colored, but has no asphaltene, then Eq. (10) or Eq. (12) can be used to find the distribution of the colored component.

Workflow

It is important that the theory can be compared in real time with the measurements. The theory predicts the gradient of the asphaltene or the gradient in the color of the oil. These expected gradients can be compared with log data (either wireline or drilling and measurement data.) If the column can be described by this simple theory, then there is no reason to take a lot of data. However, if the mismatch between the log data and the theory is sufficiently large, then the procedure would be to follow up with taking more data, because in this case the column requires a more complex formalism to describe it. For example, it can be out of equilibrium, it could be compartmentalized or it is too complex a fluid to be described by our simple model.

One example of the complexity of the fluid is when the asphaltene aggregates or flocculates. If the asphaltene starts forming aggregates, then its volume and possibly its effective solubility parameter could vary. At higher concentrations of asphaltene, as the pressure and temperature of the oil is changed, the asphaltenes can flocculate and precipitate out. The stability of the asphaltene will depend on the solubility parameters of the maltene and the asphaltene and also on the concentration of the asphaltene. If these are varying, there will be different asphaltene onset pressures at different heights of the column. By determining these varying solubilities and concentrations, either by using the equilibrium model or by taking additional measurements, this change in stability could be estimated.

Figure 1B:
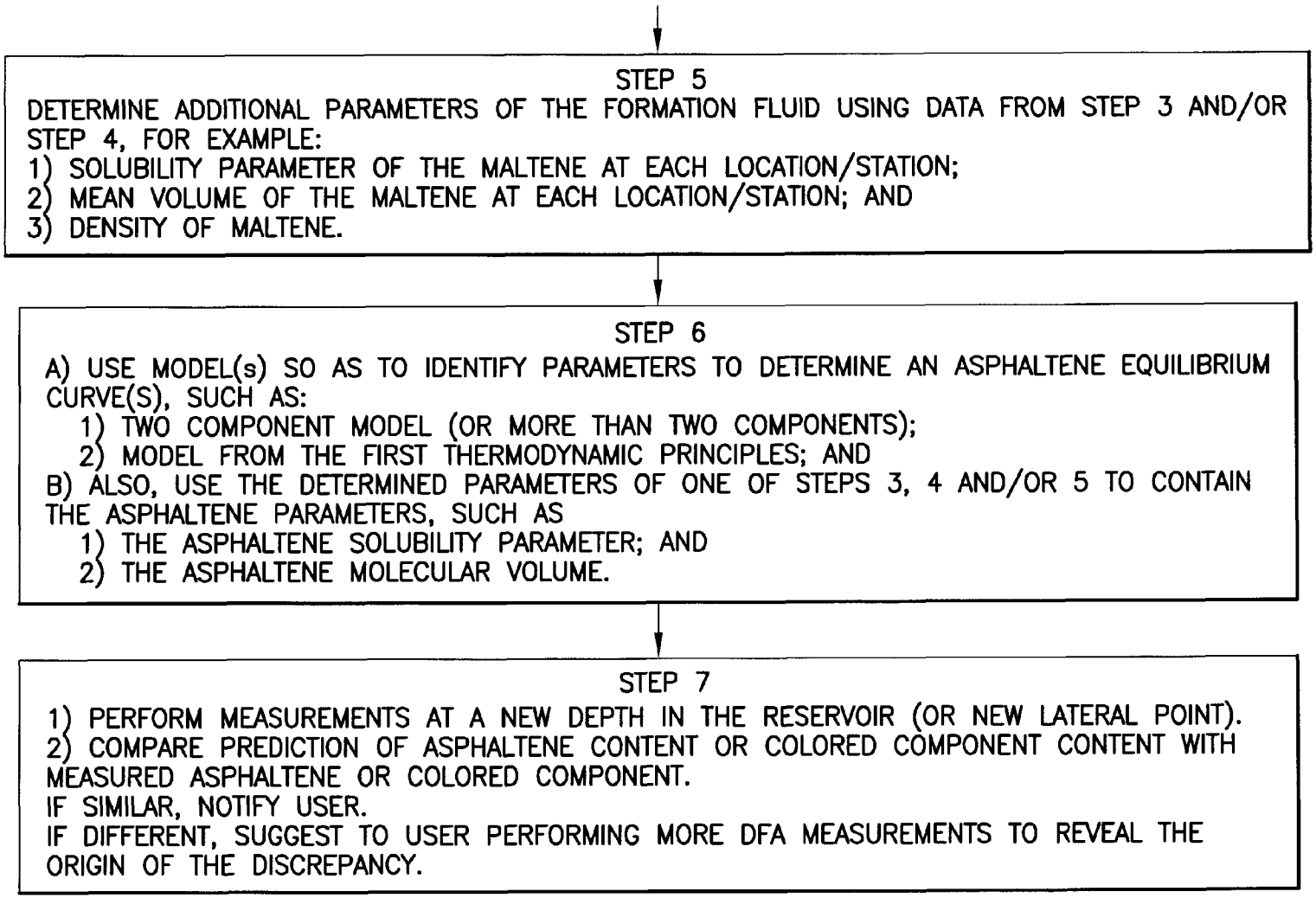

FIGS. 1*a* and 1*b* disclose a general flowchart according to an embodiment of the invention. Step 1 includes identifying one or more station in a column within a borehole, and one or more data gathering tool such as a DFA, IFA, OFA, or CFA type device. Alternate Step 1 provides for the use known lab data from oil samples from the reservoir or use known basin modeling to predict light end spatial distribution. Use this variation to help predict how asphaltene content varies or relative asphaltene content varies with depth. Optionally, if the conditions in alternate step 1 are met, then it is possible to go to step 7. Step 2 provides for an input tool data at one or more location/Station and communicate collected tool Data to a processor. Step 3 includes determining formation properties for each location/station, for example: $T_{res}$ $P_{res}$, depth, etc. Step 4 includes determining the composition of oil in terms of components or pseudo components for each location/station. For example: 1) Calculate weight % of $CO_2$, $C_1$, $C_2$, $C_3$-$C_5$, $C_{6+}$; 2) use known solubility parameters to calculate the solubility parameter of the live oil—or to calculate the solubility parameter relative to other compositions in the oil column; 3) Determine relative amounts (or absolute amounts) of asphaltene or colored components; 4) Determine optical densities; and 5) Determine gas/oil ratios (GOR). It is also possible in Step 4 to compare results with a database of historical reservoir data to determine if the measured data makes sense? If yes, goto step 5, if data does not make sense, repeat steps 2-4 with one or more location /stations. Step 5 includes determining additional parameters of the formation fluid using data from step 3 and/or step 4, for example: 1) solubility parameter of the Maltene at each location/station; 2) mean volume of the Maltene at each location/station; and 3) Density of maltene. Step 6 includes step 6(A) includes using the Model(s) so as to identify parameters to determine an Asphaltene Equilibrium curve(s), such as: 1) Two Component Model (or more than two components); 2) Model from the first thermodynamic principles. Step 6(B) includes also, using the determined parameters of one of steps 3, 4 and/or 5 to contain the Asphaltene parameters, such as: 1) the Asphaltene solubility parameter; and 2) the Asphaltene molecular volume. Step 7 includes the following: 1) Perform Measurements at a new depth in the reservoir (or new lateral point); 2) Compare prediction of asphaltene content or colored component content with measured asphaltene or colored component. Based on making an analysis if similar, then notify user. However, if from the analysis it is different, then suggest to user performing more DFA measurements to reveal the origin of the discrepancy.

Figure 2A:
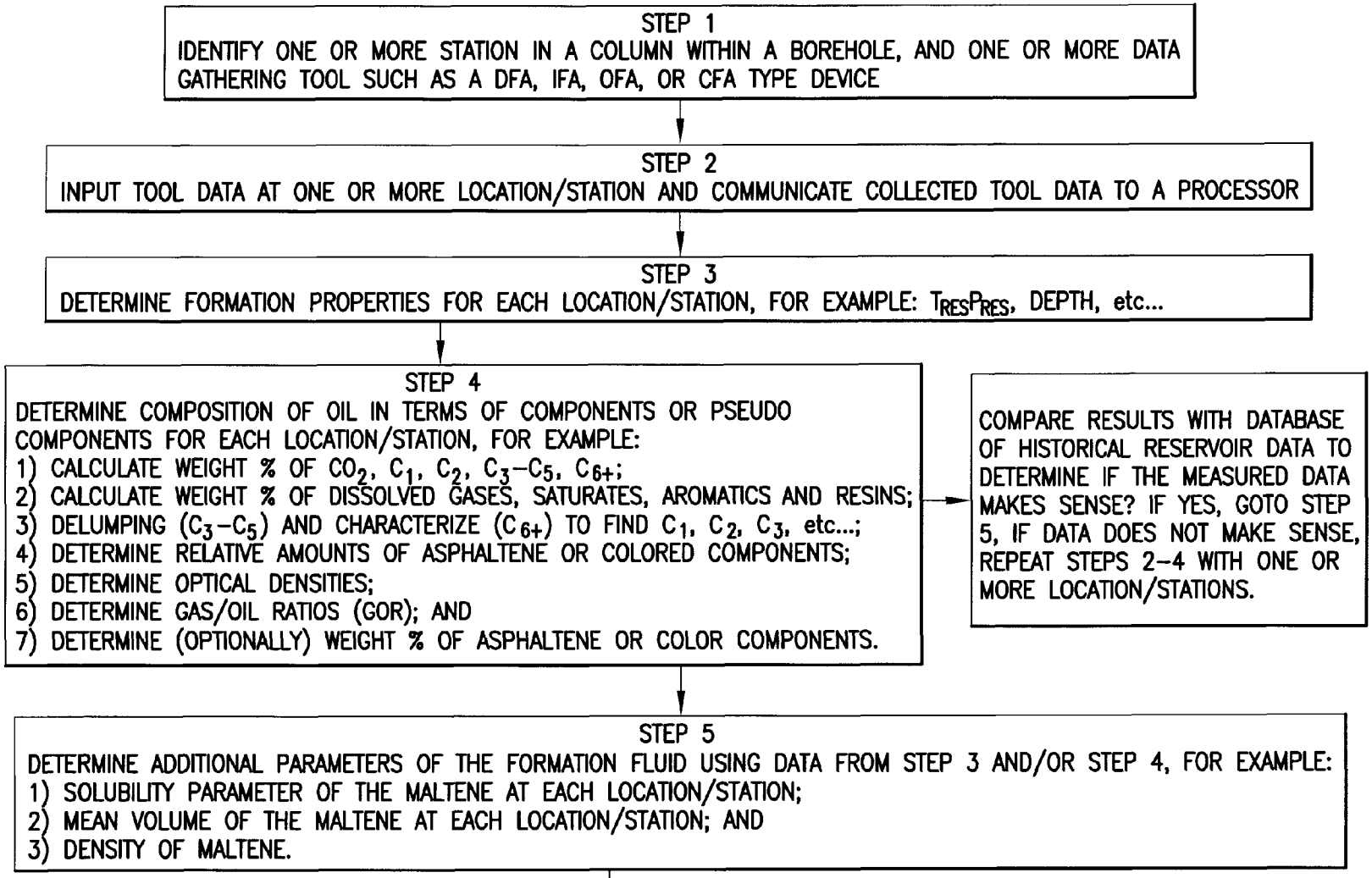
FIGS. 2*a*, 2*b* and 2*c* illustrate a general workflow diagram, according to at least one embodiment of the invention.
Figure 2B:
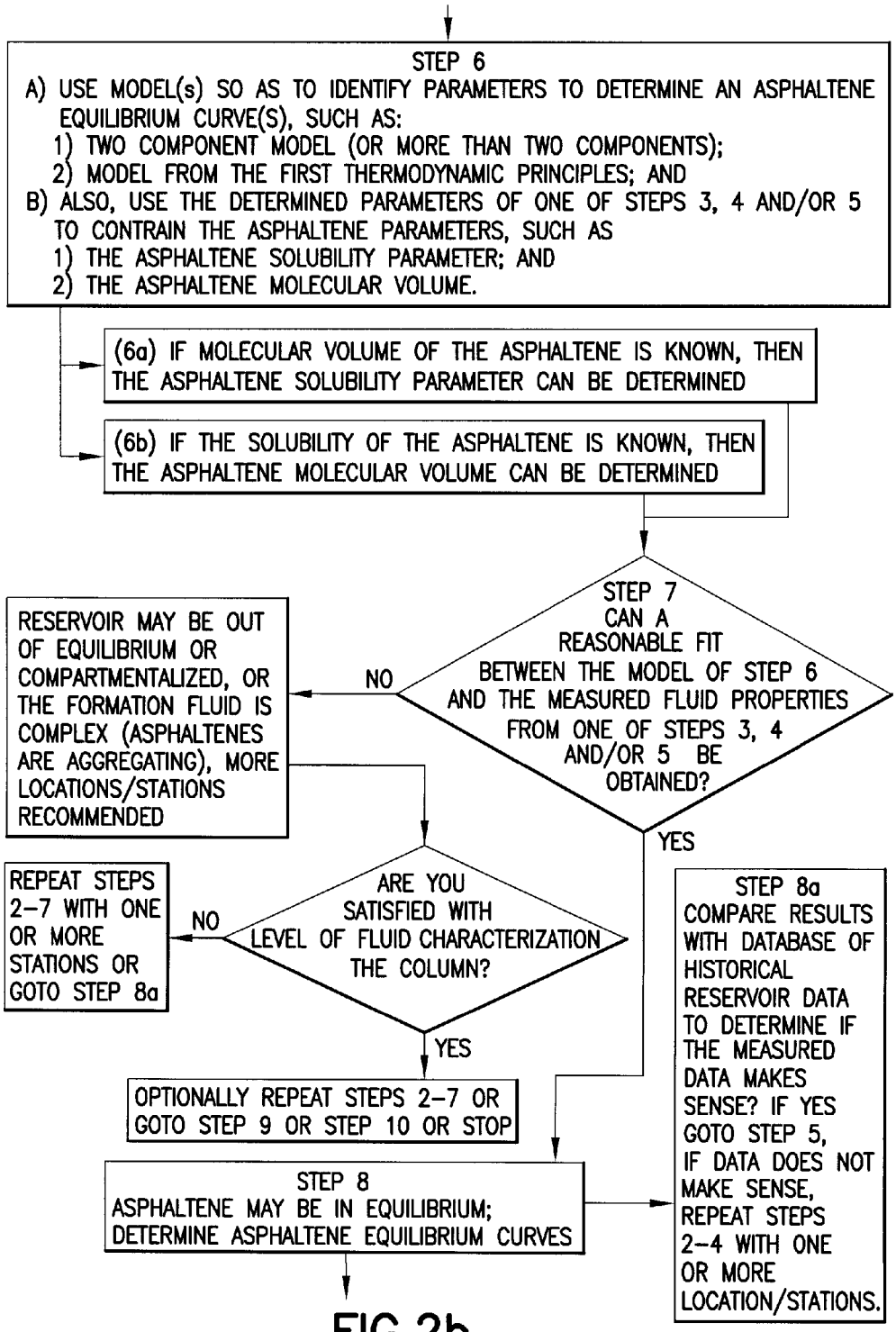
Figure 2C:
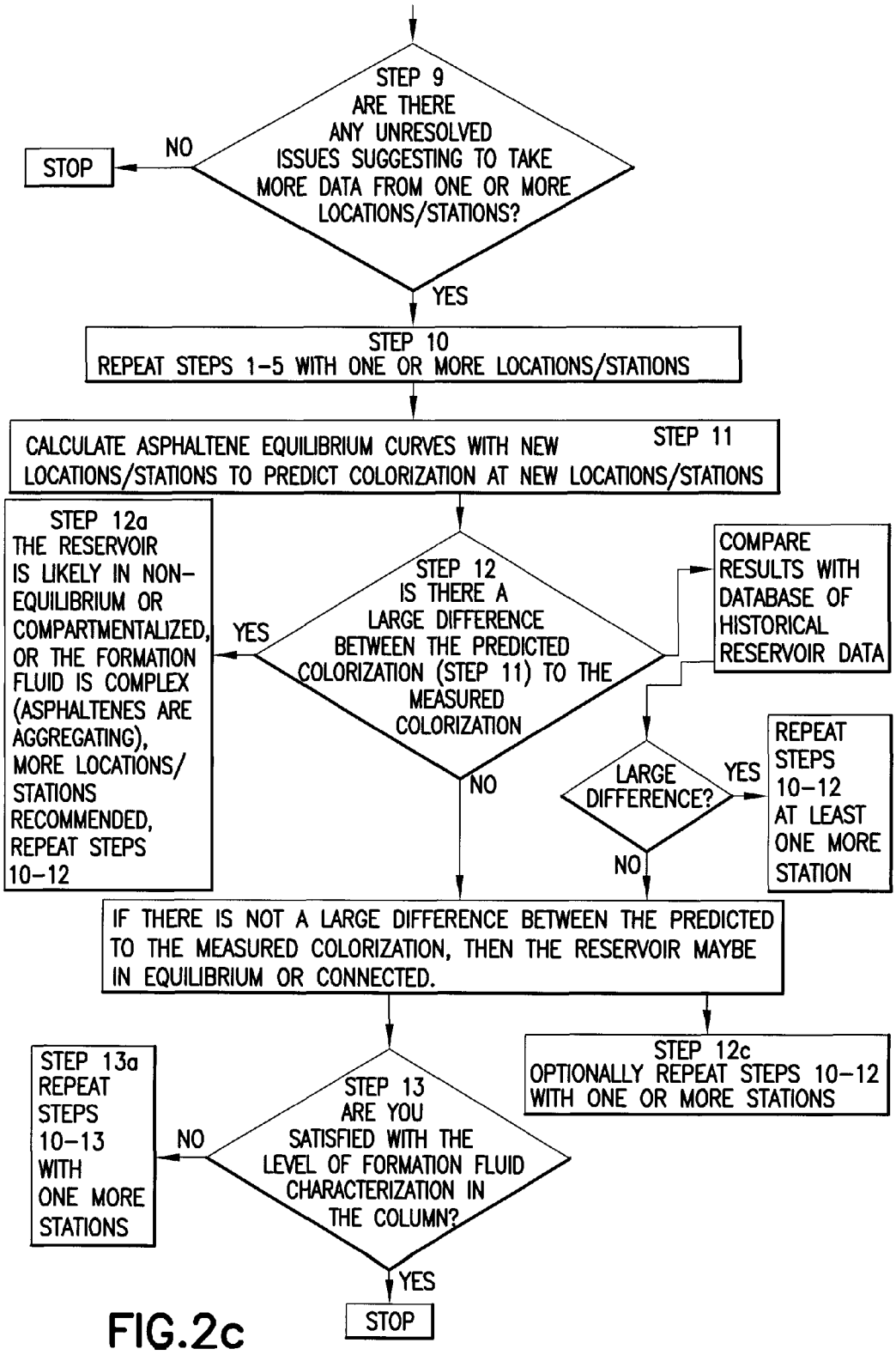

FIGS. 2*a*, 2*b* and 2*c* disclose a more detailed flowchart according to an embodiment of the invention.

Referring to FIG. 2*a*, Step 1 includes identifying one or more station in a column within a borehole, and one or more data gathering tool such as a DFA, IFA, OFA, or CFA type device.

Still referring to FIG. 2*a*, Step 2 includes Inputting tool Data at one or more location/Station and communicate collected tool Data to a processor.

Still referring to FIG. 2*a*, Step 3 includes determining formation properties for each location/station, for example: $T_{res}$ $P_{res}$, depth, etc.

Still referring to FIG. 2*a*, Step 4 includes determining composition of oil in terms of components or pseudo components for each location/station. For example: 1) Calculate weight % of $CO_2$, $C_1$, $C_2$, $C_3$-$C_5$, $C_{6+}$; 2) Calculate weight % of dissolved gases, saturates, aromatics and resins; 3) Delumping ($C_3$-$C_5$) and characterize ($C_{6+}$) to find $C_1$, $C_2$, $C_3$, etc . . . ; 4) Determine relative amounts of asphaltene or colored components; 5) Determine optical densities; 6) Determine gas/oil ratios (GOR); and 7) Determine (optionally) weight % of Asphaltene or color components. Optionally, from Step 7 it is possible to compare results with Database of historical reservoir data to determine if the measured data makes sense? If yes, goto Step 5, if data does not make sense, repeat Steps 2-4 with one or more location/stations.

Still referring to FIG. 2*a*, Step 5 includes determining additional parameters of the formation fluid using data from Step 3 and/or Step 4, for example: 1) solubility parameter of the Maltene at each location/station; 2) mean volume of the Maltene at each location/station; and 3) density of maltene.

Still referring to FIG. 2*a*, Step 6 includes going to Step 6(A) using a Model(s) so as to identify parameters to determine an Asphaltene Equilibrium curve(s), such as: 1) two Component Model (or more than two components); and 2) model from the first thermodynamic principles. Then to Step 6(B) also, using the determined parameters of one of Steps 3, 4 and/or 5 to constrain the Asphaltene parameters, such as: 1) the Asphaltene solubility parameter; and 2) the Asphaltene molecular volume.

Referring to FIG. 2*b*, Then to Step 6(*a*), determine if molecular volume of the Asphaltene is known, then the Asphaltene solubility parameter can be determined; and then to Step (6*b*) determine if the solubility of the Asphaltene is known, then the Asphaltene molecular volume can be determined.

Still referring to FIG. 2*b*, Step 7 makes the analysis of can a reasonable fit between the model of Step 6 and the measured fluid properties from one of Steps 3, 4, and/or 5 be obtained? If No, then reservoir may be out of equilibrium or compartmentalized, or the formation fluid is complex (Asphaltenes are aggregating), more locations/stations recommended. Then, a determination is made as to are you satisfied with level of fluid characterization the column? If no, then repeat Steps 2-7 with one or more stations or goto Step 8(*a*). If yes, then optionally repeat Steps 2-7 or goto Step 9 or Step 10 or STOP and/or goto Step 8.

Still referring to FIG. 2*b*, Step 8 includes making a determination if the Asphaltene may be in equilibrium; then determine Asphaltene Equilibrium Curves. Optionally, Step 8(*a*) includes comparing results with Database of historical reservoir data to determine if the measured data makes sense? If yes, goto Step 5, if data does not make sense, repeat Steps 2-4 with one or more location/stations.

Referring to FIG. 2*c*, Step 9 determines are there any unresolved issues suggesting to take more data from one or more locations/stations? If no, then stop. If yes, then goto Step 10.

Still referring to FIG. 2*c*, Step 10 includes repeating Steps 1-5 with one or more locations/stations.

Still referring to FIG. 2*c*, Step 11 includes calculating Asphaltene Equilibrium Curves with new locations/stations to predict colorization at new locations/stations.

Still referring to FIG. 2*c*, Step 12 determines is there a large difference between the PREDICTED colorization (Step 11) to the MEASURED colorization? Optional, it is possible to compare results with Database of historical reservoir data, then determine if there is a large difference? If yes, then repeat Steps 10-12 with at least one more station. However, if no, then goto Step 12(*b*), wherein Step 12(*b*) determines if there is not a large difference between the PREDICTED to the MEASURED colorization, then the reservoir maybe in equilibrium or connected. Optionally, it is possible to goto Step 12(*c*), so as to repeat Steps 10 thru 12 with one or more stations.

Still referring to FIG. 2*c*, Step 13 includes determining are you satisfied with the level of formation fluid characterization in the Column? If no, the goto Step (13*a*) and repeat Steps 10 thru 13 with one or more stations. If yes, then STOP.

Whereas many alterations and modifications of the present invention will no doubt become apparent to a person of ordinary skill in the art after having read the foregoing description, it is to be understood that the particular embodiments shown and described by way of illustration are in no way intended to be considered limiting. For example, more complex models could be used, e.g., more components used in the model, non linear corrections could be added to the model, SAFT could be used for modeling. It is also possible that different choices of the components or pseudo components could be used to calculate the asphaltene equilibrium curves and the maltene solubility parameter. For example, the difference choices may include: 1) treating the maltene as two components, such as the dissolved gases and the liquid phase; 2) treating the dissolved gases as more than one component such as dividing the dissolved gas into $CO_2$, $C_1$, $C_2$, $C_3$-$C_5$ and/or any variation thereof; 3) dividing the liquid phase into more than one component, such as alkanes and aromatics or alkanes and aromatics and resins or and/or any variation thereof. The asphaltene or color component can be treated as more than one component, such as a more soluble component and a less soluble component.

Further, it is possible that other tools maybe used such as OFA, CFA and/or IFA or other wireline or drilling and measurement (D&M) tools. Further, it is possible that the solubility parameter for some components of the maltene could be additional fitting parameters or the maltene solubility parameter could be found using an Equation of State (EOS). It should be noted that if different zones or compartments are identified, this method could be repeated with each zone or compartment. Also, it should be noted that if there is a large amount of asphaltene, the theory (method) could be modified to include the effect that the asphaltene has on the compositional gradient of the maltene. If there is a large temperature gradient, the theory (method) could be modified to account for a temperature gradient.

Further still, while the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method of characterizing a fluid in a reservoir using asphaltene content to determine whether the fluid has an equilibrium distribution as a function of depth within the reservoir, the method comprising:

(a) using a tool to acquire tool data for a plurality of fluid samples within the reservoir, wherein each fluid sample is at a different depth in the reservoir;

(b) determining formation properties for each fluid sample to obtain formation property data;

(c) determining fluid properties for each fluid sample to obtain fluid property data; and (d) in a computer processor, using a mathematical model based on gravity and solvency power to determine a predicted asphaltene content as a function of depth in the reservoir, wherein the mathematical model uses at least one of the tool data, the formation property data, the fluid property data, or known fluid reservoir data to determine the predicted asphaltene content;

(e) comparing at least one measured asphaltene content at a depth in the reservoir with the predicted asphaltene content from the model at that depth to predict whether the fluid in the reservoir has an equilibrium distribution as a function of depth within the reservoir.

2. The method of claim 1, wherein the measured asphaltene content is at least one of asphaltene concentration or a concentration of a colored component.

3. The method of claim 1, wherein the measured asphaltene content is a colored component concentration and the colored component comprises one or more chemical constituents with electronic absorption bands in at least one of:

a near ultra violet (UV) range, a visible range, or a near infrared spectral range.

4. The method of claim 1, wherein the formation property data includes at least one of:

a temperature for each fluid sample, a pressure for each fluid sample, or a depth for each fluid sample.

5. The method of claim 1, wherein fluid property data includes at least one of:

a density for at least one fluid sample, a molar volume of at least one fluid sample, a solubility parameter for at least one fluid sample, an asphaltene concentration for at least one fluid sample, a color for at least one fluid sample, an optical density for at least one fluid sample, a gas/oil ratio (GOR) for at least one fluid sample, a concentration of dissolved gases for at least one fluid sample, a concentration of saturates for at least one fluid sample, a concentration of aromatics for at least one fluid sample, a concentration of resins for at least one fluid sample, or a concentration of at least one of $CO_2$, $C_1$, $C_2$, $C_3$-$C_5$, and $C_{6+}$ for at least one fluid sample.

6. The method of claim 1, further comprising:

selecting the mathematical model based on at least one fluid property of at least one fluid sample, the at least one fluid property including at least one of asphaltene concentration or a colored component concentration.

7. The method of claim 6, wherein the fluid is a live oil and the mathematical model (1) characterizes a distribution of the live oil such that at least one fluid property of at least one fluid sample includes asphaltenes solvated by a liquid fraction and (2) correlates a solvating power of the liquid fraction for at least one of the asphaltenes or a color component so as to determine whether the live oil is in a thermodynamic equilibrium in the reservoir.

8. The method of claim 1, wherein the fluid is at least one of:

a multiphase fluid, a single phase fluid, an oil, a heavy oil, or a live oil.

9. The method of claim 1, wherein the mathematical model accounts for variations in a light component of the fluid due to compressiblity of the fluid at various depths of the reservoir.

10. The method of claim 1, wherein the mathematical model is based on an asphaltene solution theory to address asphaltene gradients in the reservoir.

11. The method of claim 1, wherein the known fluid reservoir data includes at least one of:

a predicted fluid property data of the fluid in at least one depth in the reservoir, a predicted equilibrium distribution based on a predicted fluid property data of the fluid in at least one depth in the reservoir, a predicted non-equilibrium distribution based on a predicted fluid property data of the fluid in at least one depth in the reservoir, or a predicted formation property data.

12. The method of claim 1, further comprising:

performing a consistency check using the known fluid reservoir data to determine validity of at least one of the tool data, the formation property data, or the fluid property data.

13. The method of claim 1, wherein the tool data includes at least one of:

acquired real-time data of at least one fluid property for at least one fluid sample, data derived from a wireline formation testing and sampling tool, data from a drilling tool, data from a production logging tool string, or data from a cased-hole bottomhole sampler.

14. The method of claim 13, wherein the tool is an optical fluid analysis tool.

15. The method of claim 1, wherein the reservoir has a depth, the fluid within the reservoir is under pressure because of the depth of the reservoir, and there is a substantial amount of dissolved gas in the fluid, wherein the dissolved gas increases compressibility of the fluid thereby resulting in increased density gradients and increased compositional gradients.

16. The method of claim 1, wherein the fluid property data includes at least one of at least one colored component, at least one non-colored component, or at least one pseudocomponent.

17. The method of claim 1, further comprising:

(f) if at least one of an asphaltene solubility parameter and an asphaltene molecular volume is unidentified in the fluid property data, adjusting at least one parameter of the mathematical model based on at least one of: (1) the formation property data, (2) the fluid property, or (3) the known reservoir property data, to generate an adjusted mathematical model; and (g) based on the adjusted mathematical model, determining whether the fluid is in one of an equilibrium distribution or a non-equilibrium distribution in the reservoir.

18. The method of claim 17, wherein adjusting the at least one parameter of the mathematical model includes adjusting at least one of a solubility parameter, a molecular volume parameter, a density parameter, or a different parameter.

19. A method according to claim 1, wherein the mathematical model is further based on entropy.

20. A method according to claim 1, wherein the mathematical model uses at least one oil solubility parameter and at least one asphaltene solubility parameter to determine the predicted asphaltene content.

21. A system for characterizing a fluid in a reservoir using asphaltene content to determine whether the fluid has an equilibrium distribution as a function of depth within the reservoir, the system comprising:

(a) a tool configured to acquire tool data for a plurality of fluid samples within the reservoir, wherein each fluid sample is at a different depth in the reservoir; and (b) a processor configured to:

i. determine formation properties for each fluid to obtain formation property data;

ii. determine fluid properties for each fluid sample to obtain fluid property data; and iii. using a mathematical model based on gravity and solvency power to determine a predicted asphaltene content as a function of depth in the reservoir, wherein the mathematical model uses at least one of the tool data, the formation property data, the fluid property data, or known fluid reservoir data to determine the predicted asphaltene content;

iv. comparing at least one measured asphaltene content at a depth in the reservoir with the predicted asphaltene content from the model at that depth to predict whether the fluid in the reservoir has an equilibrium distribution as a function of depth within the reservoir.

22. The system of claim 21, wherein the processor is further configured to:

v. if at least one of an asphaltene solubility parameter and an asphaltene molecular volume is unidentified in the fluid property data, adjust at least one parameter of the mathematical model based on at least one of: (1) the formation property data, (2) the fluid property data, or (3) the known reservoir property data , to generate an adjusted mathematical model; and vi. based on the adjusted mathematical model, determine whether the fluid is in one of an equilibrium distribution or a non-equilibrium distribution in the reservoir.

23. The system of claim 21, wherein the tool is an optical fluid analysis tool.

24. The system of claim 21, wherein the measured asphaltene content is at least one of asphaltene concentration or a concentration of a colored component.

25. The system of claim 21, wherein the formation property data includes at least one of:

a temperature for each fluid sample, a pressure for each fluid sample, or a depth for each fluid sample.

26. The system of claim 21, wherein fluid property data includes at least one of:

a density for at least one fluid sample, a molar volume of at least one fluid sample, a solubility parameter for at least one fluid sample, an asphaltene concentration for at least one fluid sample, a color for at least one fluid sample, an optical density for at least one fluid sample, a gas/oil ratio (GOR) for at least one fluid sample, a concentration of dissolved gases for at least one fluid sample, a concentration of saturates for at least one fluid sample, a concentration of aromatics for at least one fluid sample, a concentration of resins for at least one fluid sample, or a concentration of at least one of $CO_2$, $C_1$, $C_2$, $C_3$-$C_5$, and $C_{6+}$for at least one fluid sample.

27. The system of claim 21, wherein the known fluid reservoir data includes at least one of:

a predicted fluid property data of the fluid in at least one depth in the reservoir, a predicted equilibrium distribution based on a predicted fluid property data of the fluid in at least one depth in the reservoir, a predicted non-equilibrium distribution based on a predicted fluid property data of the fluid in at least one depth in the reservoir or a predicted formation property data.

28. A system according to claim 21, wherein the mathematical model is further based on entropy.

29. A system according to claim 21, wherein the mathematical model uses at least one oil solubility parameter and at least one asphaltene solubility parameter to determine the predicted asphaltene content.

30. A method of deriving predicted asphaltene content of a downhole fluid in a reservoir to determine whether the fluid has an equilibrium distribution as a function of depth within the reservoir, the method comprising:

(a) determining formation properties for a plurality of fluid samples from the downhole fluid in the reservoir to obtain formation property data, wherein each fluid sample is at a different depth in the reservoir;

(b) determining fluid properties for each fluid sample of the downhole fluid in the reservoir to obtain fluid property data, wherein fluid property data includes at least one of:
a density for at least one fluid sample,
a molar volume of at least one fluid sample,
a solubility parameter for at least one fluid sample,
an asphaltene concentration for at least one fluid sample,
a color for at least one fluid sample,
an optical density for at least one fluid sample,
a gas/oil ratio (GOR) for at least one fluid sample,
a concentration of dissolved gases for at least one fluid sample,
a concentration of saturates for at least one fluid sample,
a concentration of aromatics for at least one fluid sample,
a concentration of resins for at least one fluid sample, or
a concentration of at least one of $CO_2$, $C_1$, $C_2$, $C_3$-$C_5$, and $C_{6+}$ for at least one fluid sample;

(c) in a computer processor, using a mathematical model based on gravity and solvency power to determine a predicted asphaltene content as a function of depth in the reservoir, wherein the mathematical model uses at least one of the formation property data, the fluid property data, or known fluid reservoir data, (d) comparing at least one measured asphaltene content at a depth in the reservoir with the predicted asphaltene content from the model at that depth to predict whether the downhole fluid in the reservoir has an equilibrium distribution as a function of depth within the reservoir.

31. A method according to claim 30, wherein the mathematical model is further based on entropy.

32. A method according to claim 30, wherein the mathematical model uses at least one oil solubility parameter and at least one asphaltene solubility parameter to determine the predicted asphaltene content.

* * * * *